US005945784A

United States Patent [19]

Mattas

[11] Patent Number: 5,945,784

[45] Date of Patent: Aug. 31, 1999

[54] HIGH INTENSITY DISCHARGE BALLAST

[75] Inventor: Charles B. Mattas, Glenview, Ill.

[73] Assignee: Philips Electronics North America Corporation, New York, N.Y.

[21] Appl. No.: 08/987,700

[22] Filed: Dec. 9, 1997

[51] Int. Cl.[6] ..... H05B 37/02

[52] U.S. Cl. ..... 315/247; 315/289; 315/290; 315/158; 315/DIG. 7

[58] Field of Search ..... 315/289, 290, 315/119, 247, 106, 105, 103, 225, 291, 244

[56] References Cited

U.S. PATENT DOCUMENTS

| | | | |
|---|---|---|---|
| 3,508,112 | 4/1970 | Peek | 315/240 |
| 4,461,982 | 7/1984 | Fahnrich | 315/290 |
| 4,749,909 | 6/1988 | Smulders | 315/106 |
| 4,866,347 | 9/1989 | Nuckolls et al. | 315/106 |
| 4,958,107 | 9/1990 | Mattas et al. | 315/289 |
| 5,289,084 | 2/1994 | Nuckolls et al. | 315/289 |
| 5,424,617 | 6/1995 | Garbowicz et al. | 315/289 |
| 5,453,666 | 9/1995 | Brown | 315/247 |
| 5,608,296 | 3/1997 | Brown | 315/289 |
| 5,616,990 | 4/1997 | Garbowicz et al. | 315/289 |

OTHER PUBLICATIONS

Gibilisco, Stan, Encyclopedia of Electronics, TAB Professional Reference Books, Page 679, 1985.

*Primary Examiner*—Don Wong
*Assistant Examiner*—Wilson Lee
*Attorney, Agent, or Firm*—Bernard Franzblau

[57] ABSTRACT

A ballast for powering a high intensity discharge lamp including an ignitor and a resonant circuit. Ignition pulses produced by the ignitor are added to a boosted low frequency voltage produced by the circuit operating near its resonant frequency during start up of the lamp. The circuit is disabled after a predetermined period of time has elapsed following ignition of the lamp. Application of the signal precedes application of the ignitor pulses to the lamp. Disablement of the circuit can render the ignitor inoperable.

19 Claims, 1 Drawing Sheet

HIGH INTENSITY DISCHARGE BALLAST

BACKGROUND OF THE INVENTION

This invention relates generally to a ballast for a high intensity discharge (HID) lamp, and more particularly to an ignition scheme for an HID lamp.

In order to ignite a conventional HID lamp, the nominal U.S. utility line voltage of 120 volts AC (VAC) is increased and in combination with very high amplitude voltage pulses of short duration is applied to the lamp. A ballast can step up the nominal U.S. utility line voltage by magnetic transformation. Such transformation results in a ballast which is undesirably bulkier and/or having unacceptably higher losses.

When the nominal line voltage is sufficiently high (e.g. at about 200 volts RMS or more), transformation is not required. A conventional ballast, without such transformation, is disclosed in U.S. Pat. No. 4,461,982. Such ballasts in providing high amplitude voltage pulses of short duration include both an oscillator and an ignitor. The amount of energy supplied by the oscillator to the lamp, however, is limited. Transfer of energy from the oscillator to the lamp occurs only during operation of the ignitor, that is, for the duration of each ignition pulse. The amount of energy stored by the oscillator and therefore available to the lamp is also limited by a storage scheme which imposes sharing of energy to be stored between the oscillator and an ignitor.

Accordingly, it is desirable to provide an improved HID ballast which is less bulky and more energy efficient. The improved ballast in providing energy from the boosted nominal line voltage to the HID lamp during starting should not be limited to the duration of the one or more ignition pulses or be limited in the amount of energy supplied to the lamp due to sharing of energy storage with an ignitor.

SUMMARY OF THE INVENTION

Generally speaking, in accordance with a first aspect of the invention, a ballast for powering a high intensity discharge lamp includes a first input terminal and a second input terminal for receiving an input voltage, a first output terminal and a second output terminal for supplying power to the lamp and a first inductor and a first capacitor serially coupled between the first input terminal and the first output terminal. The ballast also includes a reactive component and a switch serially coupled between the second output terminal and a junction joining the first inductor and the first capacitor together. The reactive component in combination with an element selected from the group consisting of the first inductor and first capacitor is characterized by a first resonant condition at a first frequency. Energy generated by the first resonant condition is supplied to the lamp for aiding ignition of the lamp.

Advantageously, even though the ballast is supplied by a 120 VAC nominal line voltage, the energy from the resonant condition is sufficient in aiding ignition to start the lamp without the need for a transformer in boosting the 120 VAC nominal line voltage to at least about 200 volts RMS. The invention provides a far more energy efficient and less bulky ballast than a conventional ballast requiring transformation in boosting the nominal line voltage to an acceptable level for starting the lamp.

In accordance with a first feature of the invention, the first inductor and first capacitor are characterized by a second resonant condition at a second frequency for sustaining lamp current during steady state operation of the lamp. In one preferred embodiment of the invention the first frequency is greater than the second frequency.

In accordance with another feature of the invention, the ballast further comprises an ignitor which includes the first inductor for generating ignition pulses. During starting of the lamp, the reactive component in combination with the selected element produce a signal associated with the first resonant condition whose ringing is extended by a second inductor when the second inductor is connected between the switch and the second output terminal . The conductive state of the switch is based on the operating state of the lamp such that the switch changes from a conductive state to a non-conductive state in response to current flowing through the lamp for a predetermined period of time.

In accordance with a second aspect of the invention, a method of igniting a high intensity discharge lamp includes applying a signal at a low frequency and of a first magnitude and ignition pulses at a high frequency and of a second magnitude to the lamp prior to ignition. The signal is produced by a circuit operating near its resonant frequency. The ignition pulses are produced by an ignitor. Application of the signal precedes application of the ignition pulses to the lamp. The ignition pulses are preferably applied to the lamp near at least one peak of the signal.

It is a feature of this method to disable the circuit after a predetermined period of time has elapsed following ignition of the lamp. The second magnitude is preferably at least ten times greater than the first magnitude. Disabling of the ignitor occurs upon or before disablement of the circuit. In yet another feature of this method, disablement of the circuit can render the ignitor inoperable.

Accordingly, it is an object of the invention to provide an improved HID ballast which is less bulky and more energy efficient than a conventional ballast.

It is another object of the invention to provide an improved HID ballast which in supplying energy to the lamp from other than an igniter does not limit such supply to the duration of the one or more ignition pulses.

It is a further object of the invention to provide an improved HID ballast which in providing energy to the lamp from both an ignitor and a resonant circuit does not limit the amount of energy generated by the resonant circuit due to sharing of energy storage with an ignitor.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all is exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
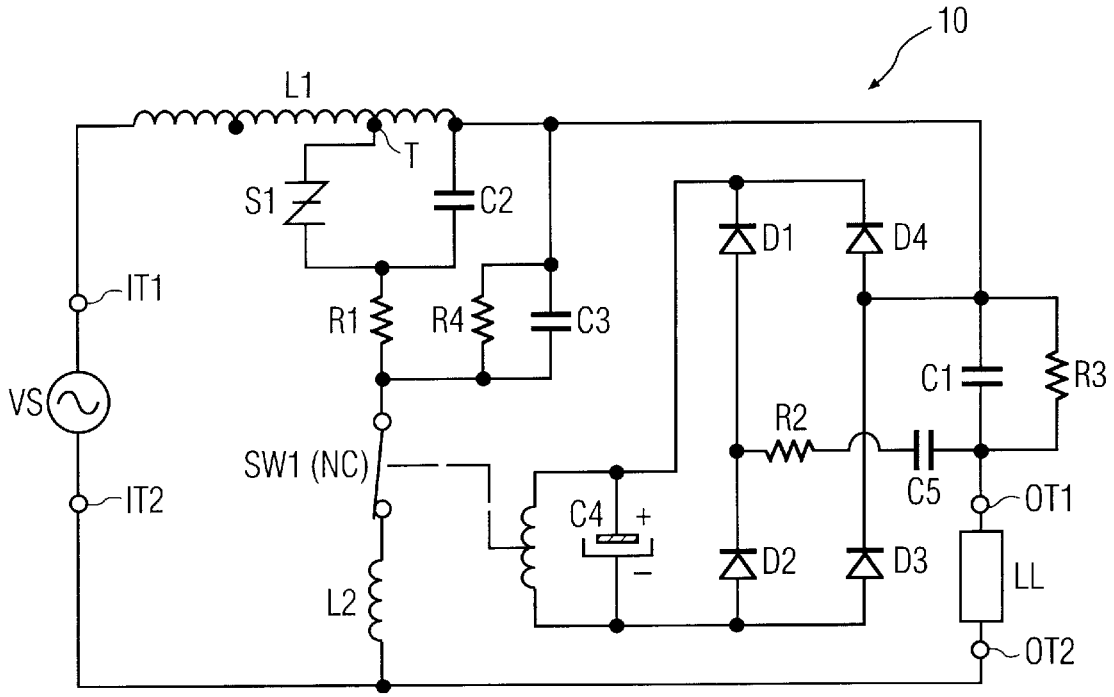
FIG. 1 is a schematic diagram of the invention in accordance with a first embodiment of the invention.

As shown in FIG. 1, a voltage source VS at 120 VAC, 60 hertz (Hz) is connected to a pair of input terminals IT1 and IT2 of a ballast 10. Ballast 10 is connected at a pair of output terminals OT1 and OT2 to an HID lamp load LL for powering the latter. A series resonant LC circuit formed by a choke (inductor) L1 and a capacitor C1 is connected between input terminal IT1 and output terminal OT1. The resonant frequency of choke L1 and capacitor C1 is near and above the frequency of the driving voltage, that is, near and above the 60 Hz frequency of voltage source VS (e.g. 75 Hz). During steady state operation of lamp load LL, that is, after lamp load LL has been successfully ignited, choke L1 and capacitor C1 serve to ballast lamp load LL. The LC combination of choke L1 and capacitor C1 operates on the capacitive side of its resonant frequency (i.e. lag type design) allowing lamps with nominal voltages above 100 VAC to be reliably ballasted from a 120 VAC source.

Ballast 10 also includes a bilateral switching device S1, such as a SIDAC, which is connected to a tap T of choke L1. A capacitor C2 is connected between a junction joining together switching device S1 and a resistor R1 and a junction joining together choke L1 and capacitor C1. A normally closed switch SW1 of a relay is connected between resistor R1 and one end of a choke (inductor) L2. The other end of choke L2 is connected to a junction joining input terminal IT2 to output terminal OT2. SW1 need not be part of a relay and can include other suitable switching devices such as, but not limited to, a transistor, bilateral switching device or a positive temperature coefficient resistor (PTC) provided that switch SW1 following a predetermined period of time after the detection of current flowing through lamp load LL is turned off (i.e. opened). In other words, once a predetermined period of time has elapsed following lamp ignition, switch SW1 in response to the flow of current through lamp load LL should change from a conductive to a nonconductive switching state.

The combination of choke L1, switching device S1, capacitor C2 and resistor R1 serve as an ignitor. During start up of lamp LL, current flows through choke L1, capacitor C2, resistor R1, switch SW1 and choke L2. Capacitor C2 charges based essentially on the RC time constant of resistor R1 and capacitor C2. The inductance of choke L2 is negligible compared to the inductance of choke L1 at the 60 Hz frequency of voltage source VS. Once the voltage across capacitor C2 reaches the breakover voltage of switching device S1, capacitor C2 discharges through switching device S1 and that portion of choke L1 connecting switching device S1 to capacitor C2. Choke L1 serves as an autotransformer increasing the voltage to several thousand volts. Capacitor C2 discharges very quickly so as to apply this very high voltage (ignition pulse) for a very short duration to lamp LL. The ignition pulse is at a very high frequency (e.g. 100 kHz). Choke L2 presents a high impedance to the ignition pulse so that loading placed on the ignition pulse by other than lamp load LL is minimized.

As capacitor C2 discharges, the voltage across switching device S1 drops below the breakdown voltage of the latter. Switching device S1 opens. Capacitor C2 begins charging once again until reaching the breakdown voltage of switching device S1. Another ignition pulse is generated as described above. Generation of these ignition pulses continues until near or at full arc discharge of lamp load LL (i.e. until stable lamp current is established). During steady state operation of lamp load LL, the voltage across capacitor C2 never reaches the breakdown voltage of switching device S1. No further generation of ignition pulses by the ignitor occurs. The ignitor is disabled.

Generation of ignition pulses cannot occur once switch SW1 opens. That is, when switch SW1 is in its non-conductive state, capacitor C2 can no longer charge. Switch SW1 changes from its conductive state to its non-conductive state in response to the flow of current through lamp load LL for a predetermined period of time. The opening of switch SW1 therefore renders the ignitor inoperable.

Switch SW1 is part of a DC actuated relay which also includes resistors R2 and R3, capacitor C1, an electrolytic capacitor C4, a capacitor C5 and a diode bridge formed by four diodes D1–D4. Once lamp load LL has ignited, current begins to flow through capacitors C1 and C5 and lamp load LL. The current flowing through capacitor C5 is rectified by the diode bridge and charges capacitor C4 to a DC voltage which energizes the relay so as to pull the normally closed contacts of switch SW1 apart and into a nonconductive state. The elapsed time for sufficiently charging capacitor C4 resulting in the opening of switch SW1 can be in, but is not limited to, the range of tens of milliseconds. The rate at which capacitor C4 charges depends primarily on the capacitance ratio between capacitors C1 and C5 and the capacitance of capacitor C4.

Resistor R3, which is connected in parallel with capacitor C1, serves to bleed off the voltage across capacitor C1, which can be several hundred volts, within a certain period of time (e.g. 30 seconds to 1 minute) for safety purposes. Resistor R2, which is in series with capacitor C5, serves to prevent an inrush of current through capacitor C5.

An HID lamp is particularly difficult to start unless the open circuit voltage is at least about 200 volts RMS. Conventional ballasts boost the voltage applied to the lamp during starting through magnetic transformation of the 120 VAC nominal line voltage. Such transformation results in bulkier ballasts and/or ballasts having much higher losses (i.e. far less efficient). In accordance with the invention, the nominal utility line voltage is increased/boosted to about at least 200 volts RMS through a series resonant LC circuit of choke L1 and capacitor C3. The resonant frequency of choke L1 and capacitor C3 is just above the driving frequency of voltage source VS, that is, just above 60 Hz (e.g. about 85 Hz).

The voltage applied to lamp load LL during starting includes the high frequency voltage pulses of several thousand volts (e.g. 3000 to 3500 volts) supplied by the ignitor added to a voltage of at least about 200 volts RMS at about 60 Hz supplied by the series resonant LC circuit of choke L1 and capacitor C3. The energy generated by the resonant circuit of choke L1 and capacitor C3 supplied to lamp load LL therefore aids in the ignition of the latter. During ignition, choke L2 dampens the ringing produced by the voltage across capacitor C3 which is applied to lamp load LL so as to last in the range of milliseconds. More particularly, during ignition choke L2 limits the amplitude and prolongs the duration of the current delivered to lamp load LL from charged capacitor C3. The period over which the energy in C3 is delivered to lamp load LL is thereby extended. Without choke L2, capacitor C3 could discharge in a few hundred microseconds thereby providing an insufficient boost to successfully ignite lamp load LL. Choke L2 helps to sustain the flow of current through lamp load LL. A resistor R4 serves to bleed off the voltage across capacitor C3 within a certain predetermined period of time (e.g. 30 seconds to 1 minute). The resonant circuit formed by choke L1 and capacitor C3 is disabled once switch SW1 opens. Choke L2 should be designed so as not to saturate during the discharge of capacitor C3 into lamp load LL. Relative to choke L1, the inductance of choke L2 is relatively small. Prior to lamp ignition, the current flowing through choke L2 can be hundreds of milliamps.

The voltage across capacitor C3 is applied to lamp load LL once ballast 10 is energized, that is, prior to the ignitor beginning its generation of ignition pulses. In other words, application of the voltage across capacitor C3 precedes application of the ignition pulses to lamp load LL. Disablement of the ignitor occurs upon or before disablement of the resonant circuit formed by choke L1 and capacitor C3.

For ballasting a 70 watt, CDM metal halide lamp typical component values for resistors R1 and R2 are about 8.2 k ohms and 100 ohms, respectively; for resistors R3 and R4 are about 2.2 M ohms; for capacitors C1, C2, C3, C4 and C5 are about 8.1 μf, 300 VAC, 0.15 μf; 630 VDC; 6.3 μf, 300 VAC; 220 μf, 25 VDC and 0.33 μf, 1K VDC, respectively; for switching device S1 is a 260v SIDAC; for diodes D1–D4 are about 1 amp, 1000v; for chokes L1 and L2 are about 530 mH at 900 ma and 35 mH at 600 ma, respectively, and the relay is about 10 A, 250 VAC, 12 VDC.

Figure 2:
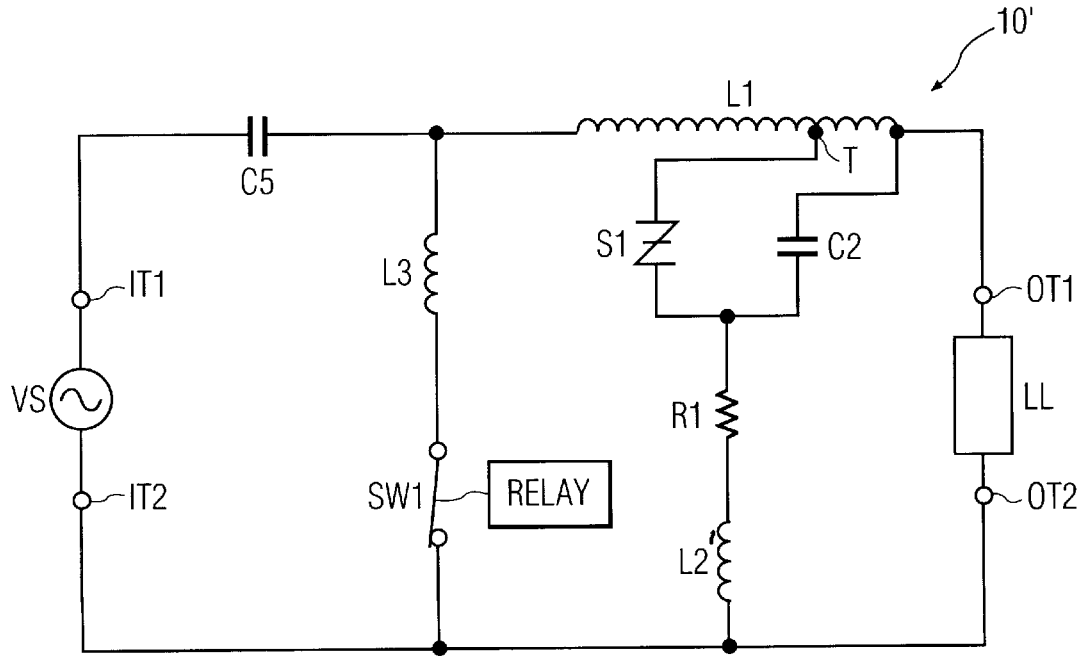
FIG. 2 is a schematic diagram of the invention in accordance with an alternative embodiment of the invention.

FIG. 2 illustrates an alternative embodiment of the invention in which like reference numerals/letters represent components of similar construction and operation. A ballast 10' includes a series resonant LC circuit of choke L1 and a capacitor C5 connected between input terminal IT1 and output terminal OT1 for ballasting lamp load LL during steady state operation. The resonant frequency of choke L1 and capacitor C5 is near and above the frequency of the driving voltage, that is, near and above the 60 Hz frequency of voltage source VS (e.g. 75 Hz). Capacitor C5 and a choke (inductor) L3 form a resonant circuit having a resonant frequency just below the driving frequency of voltage source VS (i.e. just below 60 Hz). Switch S1 is normally closed. The conductive state of switch S1 is controlled by a conventional relay RLY which causes S1 to open in response to the flow of current through lamp LL for a predetermined period of time.

During ignition, the ignitor circuit formed by choke L1, switching device S1, capacitor C2 and resistor R1 generates ignition pulses which are added to the voltage of at least about 200 volts rms, 60 Hz developed across choke L3. These boosted ignition pulses are applied to lamp load LL. A choke L2', which is connected between resistor R1 and the junction joining input terminal IT2 to output terminal OT2, is negligible compared to choke L1 at the 60 Hz frequency of voltage source VS. Choke L2' presents a high impedance to the ignition pulse so that loading placed on the ignition pulse by other than lamp load LL is minimized.

In both ballasts 10 and 10', the ignition pulses occur near the peaks of the 60 Hz oscillator output. Consequently, when a momentary breakdown of lamp load LL takes place as a result of the ignition pulse, the energy stored by capacitor C3 of ballast 10 or by choke L3 of ballast 10' is delivered to the lamp to help sustain the discharge.

As can now be readily appreciated, the resonant circuits formed by choke L1 and capacitor L3 and by choke L3 and capacitor C5 of ballasts 10 and 10', respectively, as compared to a transformer within a conventional ballast are far more efficient in increasing the 120 VAC nominal line voltage. The ballasts 10 and 10' as compared to a conventional ballast are also far less bulky by not having to incorporate a transformer for stepping up the 120 VAC nominal line voltage.

It will thus be seen that the objects set forth above and those made apparent from the preceding description are efficiently attained and, since certain changes can be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

I claim:

1. A ballast for powering a high intensity discharge lamp, comprising:

a first input terminal and a second input terminal for receiving an input voltage;

a first output terminal and a second output terminal for supplying power to the lamp;

a first inductor and a first capacitor serially coupled between the first input terminal and the first output terminal; and a reactive component and a switch serially coupled between the second output terminal and a junction joining the first inductor and the first capacitor together, the reactive component in combination with an element selected from the group consisting of the first inductor and first capacitor characterized by a first resonant condition at a first frequency;

wherein the first inductor and first capacitor are characterized by a second resonant condition at a second frequency for sustaining lamp current during steady state operation, and wherein energy generated by the first resonant condition is supplied to the lamp for aiding ignition of the lamp.

2. The ballast of claim 1, wherein the first frequency is greater than the second frequency.

3. The ballast of claim 1, further including an ignitor which includes the first inductor for generating ignition pulses.

4. The ballast of claim 1, further including a second inductor connected between the switch and the second output terminal.

5. The ballast of claim 4, wherein during starting of the lamp the reactive component in combination with the selected element produce a signal associated with the first resonant condition whose ringing is extended by the second inductor.

6. The ballast of claim 1, wherein the conductive state of the switch is based on the operating state of the lamp.

7. The ballast of claim 6, wherein the switch changes from a conductive state to a non-conductive state in response to current flowing through the lamp for a predetermined period of time.

8. The ballast of claim 1, wherein the reactive component is a capacitor.

9. The ballast of claim 1, wherein the reactive component is an inductor.

10. The ballast of claim 3, further including a second inductor connected between the switch and the second output terminal.

11. The ballast of claim 10, wherein during starting of the lamp the reactive component in combination with the selected element produce a signal associated with the first resonant condition whose ringing is extended by the second inductor.

12. The ballast of claim 11, wherein the reactive component is a capacitor.

13. A method of igniting a high intensity discharge lamp, comprising:

temporarily applying a signal at a low frequency and of a first magnitude to the lamp prior to ignition, the first magnitude being higher in magnitude than an input voltage used to operate the lamp during steady state operation, the signal being produced by a resonant circuit operating near its resonant frequency; and applying ignition pulses at a high frequency and of a second magnitude to the lamp prior to ignition, the ignition pulses being produced by an ignitor;

wherein application of the signal precedes application of the ignition pulses to the lamp and is discontinued during steady state operation of the lamp.

14. The method of claim 13, wherein the ignition pulses are applied to the lamp near at least one peak of the first signal.

15. The method of claim 13, further including disabling the circuit after a predetermined period of time has elapsed following ignition of the lamp.

16. A method of igniting a high intensity discharge lamp, comprising:

applying a signal at a low frequency and of a first magnitude to the lamp prior to ignition, the signal being produced by a circuit operating near its resonant frequency; and applying ignition pulses at a high frequency and of a second magnitude to the lamp prior to ignition, the ignition pulses being produced by an ignitor;

wherein application of the signal precedes application of the ignition pulses to the lamp, and wherein the second magnitude is at least ten times greater than the first magnitude.

17. The method of claim 15, further including disabling the ignitor upon or before disablement of the circuit.

18. The method of claim 15, wherein disablement of the circuit renders the ignitor inoperable.

19. A ballast for powering a high intensity discharge lamp, comprising:

a first input terminal and a second input terminal for receiving an input voltage;

a first output terminal and a second output terminal for supplying power to the lamp;

a first inductor and a first capacitor serially coupled between the first input terminal and the first output terminal; and a reactive component and a switch serially coupled between the second output terminal and a junction joining the first inductor and the first capacitor together, the reactive component in combination with an element selected from the group consisting of the first inductor and first capacitor characterized by a first resonant condition at a first frequency;

wherein energy generated by the first resonant condition is supplied to the lamp for aiding ignition of the lamp.

* * * * *